US008818243B2

(12) United States Patent
Shirodai

(10) Patent No.: US 8,818,243 B2
(45) Date of Patent: Aug. 26, 2014

(54) WET-TYPE DEVELOPMENT DEVICE AND WET-TYPE IMAGE FORMING APPARATUS

(75) Inventor: Yasuo Shirodai, Nara (JP)

(73) Assignee: Konica Minolta Holdings, Inc., Tokyo (JP)

( * ) Notice: Subject to any disclaimer, the term of this patent is extended or adjusted under 35 U.S.C. 154(b) by 260 days.

(21) Appl. No.: 13/491,281

(22) Filed: Jun. 7, 2012

(65) Prior Publication Data

US 2012/0321351 A1 Dec. 20, 2012

(30) Foreign Application Priority Data

Jun. 17, 2011 (JP) ..... 2011-134853

(51) Int. Cl.
*G03G 15/10* (2006.01)

(52) U.S. Cl.
USPC ..... 399/237

(58) Field of Classification Search
USPC ..... 399/237, 238, 248
See application file for complete search history.

(56) References Cited

U.S. PATENT DOCUMENTS

| | | | | |
|---|---|---|---|---|
| 7,177,576 | B2 * | 2/2007 | Kamijo et al. | 399/237 |
| 7,403,736 | B2 * | 7/2008 | Fujita et al. | 399/237 |
| 2010/0124428 | A1 * | 5/2010 | Tabata et al. | 399/57 |

FOREIGN PATENT DOCUMENTS

| | | |
|---|---|---|
| JP | 2004-008946 | 1/2004 |

* cited by examiner

*Primary Examiner* — Sandra Brase
(74) *Attorney, Agent, or Firm* — Brinks Gilson & Lione

(57) ABSTRACT

A wet-type development device includes a draw-up roller and a conveyance roller rotating in contact with each other's surface, and a developer regulating member arranged facing to and keeping a distance from a nip section formed between the draw-up roller and the conveyance roller at the contact surface. The developer regulating member forms a storage space for storing developer to be supplied toward the nip section, on the upstream side of the nip section. The fluid level of developer in the vertical direction in the storage space is higher than the nip section when the developer is being supplied to the nip section.

16 Claims, 7 Drawing Sheets

WET-TYPE DEVELOPMENT DEVICE AND WET-TYPE IMAGE FORMING APPARATUS

This application is based on Japanese Patent Application No. 2011-134853 filed with the Japan Patent Office on Jun. 17, 2011, the entire content of which is hereby incorporated by reference.

BACKGROUND OF THE INVENTION

1. Field of the Invention

The present invention relates to a wet-type development device and a wet-type image forming apparatus installed in a copier, a printer, a facsimile, or an all-in-one multifunction peripheral for forming a toner image using developer.

2. Description of the Related Art

Japanese Laid-Open Patent Publication No. 2004-008946 (Document 1) discloses a technique in which two rotatable members arranged to face each other are brought into contact with each other to form a thin layer on a surface of one of the rotatable members. The thin layer is formed at a nip section, which is a section where the two rotatable members are in contact with each other.

Referring to FIG. 13, a general wet-type development device will be described. FIG. 13 is a perspective view of a draw-up roller 110 and a conveyance roller 120 included in a general wet-type development device. In the general wet-type development device, a thin layer is formed on conveyance roller 120 using developer W stored in a developer container 148. Developer W includes carrier liquid and toner.

Draw-up roller 110 is provided between conveyance roller 120 and developer container 148 so as to be in contact with conveyance roller 120. Draw-up roller 110 is partially soaked in developer W in developer container 148. Draw-up roller 110 rotates in a direction of an arrow AR110. Conveyance roller 120 rotates in a direction of an arrow AR120 in contact with draw-up roller 110. With the rotation of draw-up roller 110, developer W in developer container 148 is drawn up toward conveyance roller 120.

Draw-up roller 110 is in contact with conveyance roller 120 at a prescribed pressure. Thus, a thin layer of developer is formed at the nip section where draw-up roller 110 and conveyance roller 120 are in contact with each other.

When a thin layer is to be formed on the surface of conveyance roller 120, a streak portion P1 of developer flowing downward in the form of a streak, a raised portion P2 of developer, a lowered portion P3 of developer, and the like may be formed on the surface of draw-up roller 110 as shown in FIG. 13, depending on the shape (diameter or length) of draw-up roller 110, the shape of conveyance roller 120, the kind of carrier liquid included in developer W, the rotational speed of draw-up roller 110, the rotational speed of conveyance roller 120, and the like.

Streak portion P1, raised portion P2, or lowered portion P3 may be produced because developer W accumulates unevenly in the axial direction of draw-up roller 110 in the vicinity of the nip section on the upstream side of the nip section (the front side on the drawing sheet of FIG. 13).

Streak portion P1 is formed such that developer W dripping downward in the form of a streak overlaps developer W drawn upward on the inside thereof whereby developer W is formed like a layer on the surface of draw-up roller 110.

Raised portion P2 is formed such that developer W accumulates in the vicinity of the nip section on the upstream side of the nip section and partially swells. Lowered portion P3 is formed such that developer W is partially lowered in the vicinity of the nip section where developer W is attracted to raised portion P2 and is reduced in amount.

When streak portion P1, raised portion P2, and lowered portion P3 are formed on the surface of draw-up roller 110, thickness variations called streak noise occur in the thin layer formed at the nip section, and the thickness of the thin layer formed on the downstream side from the nip section becomes uneven.

SUMMARY OF THE INVENTION

The present invention is made in view of the foregoing situations. An object of the present invention is to provide a wet-type development device capable of forming a uniform thin layer at a nip section.

A wet-type development device and a wet-type image forming apparatus according to an aspect of the present invention includes: a first rotatable member and a second rotatable member configured to rotate being in contact with each other's surfaces; and a developer regulating member arranged facing to and keeping a distance from a nip section between the first and second rotatable members. The developer regulating member forms a storage space for storing developer to be supplied toward the nip section, on an upstream side of the nip section with respect to a direction in which the first and second rotatable members are rotating. The fluid level in the vertical direction of the developer in the storage space is higher than the nip section when the developer is being supplied to the nip section.

The wet-type development device in accordance with the present invention can form a uniform thin layer at the nip section.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
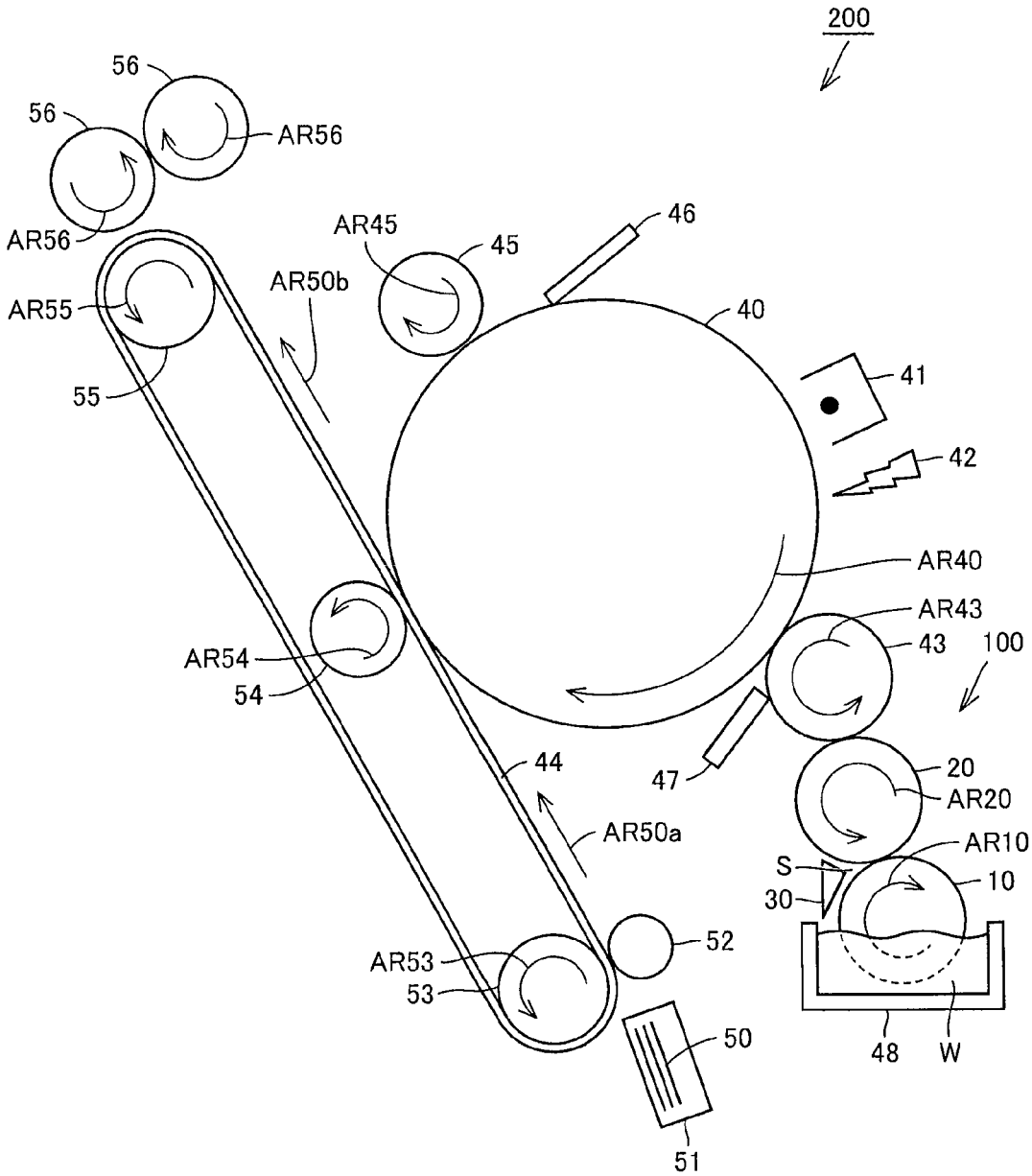
FIG. 1 is a diagram schematically showing an overall configuration of a wet-type image forming apparatus in a first embodiment.

Embodiments of the present invention will be described below with reference to the drawings. The scope of the present invention is not limited to the number and quantity mentioned in the description of the embodiment, unless otherwise specified. The same or corresponding parts in the embodiments are denoted with the same reference numerals, and an overlapping description is not repeated. It is initially intended to combine the configurations in the embodiments as appropriate as long as there is no limitation.

[First Embodiment]

Referring to FIG. 1, an overall configuration of a wet-type image forming apparatus 200 in an embodiment of the present invention will be described.

Wet-type image forming apparatus 200 includes a development device 100, an image carrier 40, a charger 41, an exposure device 42, a paper conveyance belt 44, a pre-agitation roller 45, a cleaning blade 46, a paper tray 51, a paper guide roller 52, support rollers 53 and 55, a transfer roller 54, and a fixing roller 56.

Development device 100 includes a developer container 48, a draw-up roller 10 (first rotatable member), a conveyance roller 20 (second rotatable member), a development roller 43, a cleaning blade 47, and a developer regulating member 30.

Image carrier 40 is formed like a drum. Charger 41, exposure device 42, development roller 43, which is a part of development device 100, paper conveyance belt 44, pre-agitation roller 45, and cleaning blade 46 are arranged around image carrier 40 in order along the rotational direction (the direction of an arrow AR40) of image carrier 40.

Development roller 43 rotates in the direction of an arrow AR43. Development roller 43 is arranged in contact with conveyance roller 20 rotating in the direction of an arrow AR20. Conveyance roller 20 is arranged in contact with draw-up roller 10 rotating in the direction of an arrow AR10. In other words, draw-up roller 10 and conveyance roller 20 rotate in contact with each other's surface such that the surfaces of the rollers move in the same direction at the contact position. Draw-up roller 10 is partially soaked in developer W in developer container 48.

Developer W stored in developer container 48 includes toner and carrier liquid. The mean particle size of toner is for example 0.1 μm to 5 μm in the case of wet-type image forming. The mean particle size of toner is preferably 0.1 μm or more in order to improve development performance. The mean particle size of toner is preferably 5 μm or less in order to improve image quality.

The developer is mainly composed of insulative liquid, which is carrier liquid, toner for developing an electrostatic latent image, and a dispersant for dispersing the toner. Any carrier liquid that is generally used for electrophotographic liquid developer can be used without limitation. Volatile liquid is preferred considering that residues on paper is should be prevented. Examples of the volatile liquid include silicone oil, mineral oil, and paraffin oil.

Any toner that is generally used for electrophotographic liquid developer can be used without limitation. Examples of a toner binder resin used include thermoplastic resins such as polystyrene resins, styrene-acrylic resins, acrylic resins, polyester resins, epoxy resins, polyamide resins, polyimide resins, and polyurethane resins.

A plurality of those resins may be mixed and used as the toner binder resin. Commercially available pigments and dyes used to color the toner can be used. Examples of the pigment may include carbon black, iron red, titanium oxide, silica, phtalocyanine blue, phtalocyanine green, sky blue, benzidine yellow, and lake red D. Examples of the dye may include Solvent Red 27 and Acid Blue 9.

The liquid developer can be prepared based on the generally used technique. For example, binder resin and pigment blended at a prescribed ratio are molten and kneaded to be dispersed evenly using a pressure kneader, a roller mill, or the like. The resultant dispersive product is finely ground, for example, by a jet mill. The resultant fine particles are classified, for example, by a wind classifier to obtain colored toner with a desired particle size.

The resultant toner and insulative liquid serving as carrier liquid are mixed at a prescribed ratio. The mixture is evenly dispersed by dispersing means such as a ball mill, resulting in a liquid developer. The density of toner is preferably 10 to 50% by mass.

Draw-up roller 10 and conveyance roller 20 are in contact with each other's surface to form a nip section (a nip section N in FIG. 2 to FIG. 4 as detailed later) between draw-up roller 10 and conveyance roller 20. Developer regulating member 30 is arranged to face the nip section at a distance from the nip section.

Paper conveyance belt 44 is formed in the form of an endless belt. Paper conveyance belt 44 is supported by a support roller 53 rotating in the direction of an arrow AR53 and a support roller 55 rotating in the direction of an arrow AR55. Transfer roller 54 is arranged to be opposed to image carrier 40 with paper conveyance belt 44 interposed therebetween.

(Operation of Wet-Type Development Device 100)

In wet-type development device 100, the surface of image carrier 40 is uniformly charged by charger 41 at a prescribed surface potential. The surface of image carrier 40 is thereafter exposed by exposure device 42 in accordance with prescribed image information. An electrostatic latent image is formed on the surface of image carrier 40.

Developer W including toner and carrier liquid as described above is stored in developer container 48. Developer W is dipped out with the rotation of draw-up roller 10 and is supplied to development roller 43 through conveyance roller 20. The electrostatic latent image formed on the surface of image carrier 40 is developed by developer W whereby a toner image is formed on the surface of image carrier 40.

Paper 50 is supplied from paper tray 51 onto paper conveyance belt 44 through paper guide roller 52. Paper conveyance belt 44 conveys paper 50 in the direction of an arrow AR50*a*. When paper 50 passes through between image carrier 40 and transfer roller 54, transfer roller 54 applies a bias of an opposite polarity to toner particles that form the toner image formed on the surface of image carrier 40. By the action of an electric field formed by transfer roller 54, the toner particles that form the toner image are transferred onto the surface of paper 50.

Paper 50 is thereafter conveyed by paper conveyance belt 44 in the direction of an arrow AR50*b* and then conveyed between fixing rollers 56 and 56 rotating in the direction of an arrow AR56. The toner image formed on paper 50 is heated and thus fixed on paper 50.

The toner particles left on the surface of image carrier 40 without being transferred onto paper 50 are smoothed by pre-agitation roller 45 rotating in the direction of an arrow AR45 and then removed by cleaning blade 46. Developer W left on development roller 43 is removed by cleaning blade 47. Printing on paper 50 by wet-type image forming apparatus 200 including wet-type development device 100 is carried out in the manner described above.

(Developer Regulating Member 30)

Figure 2:
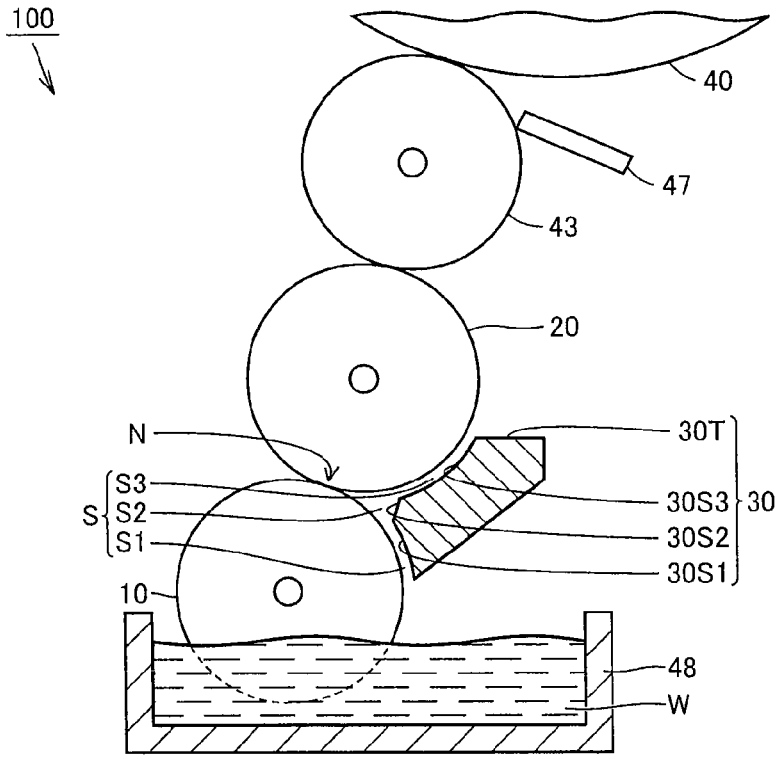
FIG. 2 is a cross-sectional view showing the vicinity of a draw-up roller, a conveyance roller, and a developer regulating member included in a wet-type development device in the first embodiment (the wet-type development device is at rest).

Referring to FIG. 2, developer regulating member 30 in wet-type development device 100 will be described in more details. FIG. 2 is a cross-sectional view showing the vicinity of draw-up roller 10, conveyance roller 20, and developer regulating member 30. In FIG. 2, wet-type development device 100 is at rest. As described above, developer regulating member 30 is arranged to face the nip section N formed between draw-up roller 10 and conveyance roller 20 at a distance therefrom.

Developer regulating member 30 is made of a resin or metal block. Developer regulating member 30 includes an inner peripheral surface 30S1 formed so as to be curved along the surface of draw-up roller 10, an inner peripheral surface 30S3 formed so as to be curved along the surface of conveyance roller 20, an inner peripheral surface 3052 formed so as to connect inner peripheral surface 30S1 and inner peripheral surface 3053, and an upper end 30T (drainage pathway).

A space 51 having a uniform sectional area along the longitudinal direction (the vertical direction on the drawing sheet of FIG. 2) is formed between inner peripheral surface 30S1 and draw-up roller 10. A space S2 having a uniform sectional area along the longitudinal direction of the nip section N is formed between inner peripheral surface 30S2 and the nip section N. A space S3 having a uniform sectional area along the longitudinal direction of the nip section N is formed between inner peripheral surface 30S3 and conveyance roller 20. Spaces S1, S2, and S3 form a storage space S.

Figure 3:
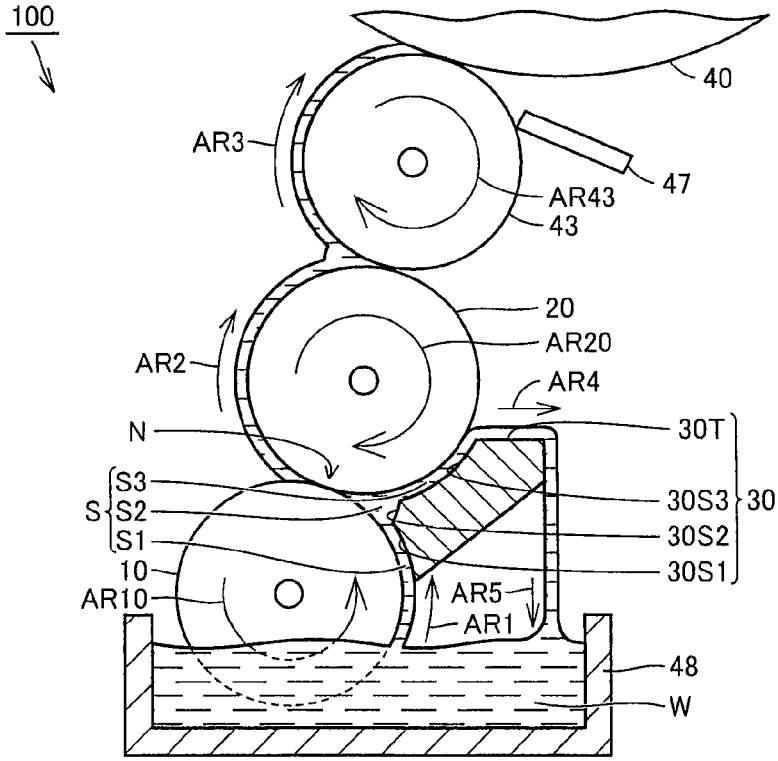
FIG. 3 is a cross-sectional view showing the vicinity of the draw-up roller, the conveyance roller, and the developer regulating member included in the wet-type development device in the first embodiment (the wet-type development device is in operation).

FIG. 3 is a cross-sectional view showing the vicinity of draw-up roller 10, conveyance roller 20, and developer regulating member 30. In FIG. 3, wet-type development device 100 is in operation. When wet-type image forming apparatus 200 prints a prescribed image on paper 50 (see FIG. 1) as described above, draw-up roller 10 rotates in the direction of arrow AR10, conveyance roller 20 rotates in the direction of arrow AR20, and development roller 43 rotates in the direction of arrow AR43.

Draw-up roller 10 partially soaked in developer W in developer container 48 rotates, and developer W is thus drawn up by draw-up roller 10 (see an arrow AR1). Developer W is supplied toward the nip section N while filling in spaces S1 and S2 in order. Developer W then enters the nip section N, which is a section where draw-up roller 10 and conveyance roller 20 are in contact with each other.

Here, developer regulating member 30 supplies developer W toward the nip section N in a state in which developer W is stored upstream of the nip section N, that is, on the upstream side in the direction in which draw-up roller 10 and conveyance roller 20 rotate and in which developer W enters the nip section N. In other words, developer regulating member 30 regulates the amount of stored developer W upstream of the nip section N in the direction in which developer W enters the nip section N.

Developer W passes through the nip section N to form a thin layer on the surface of conveyance roller 20. Developer W formed in a thin layer is conveyed further upward with the rotation of conveyance roller 20 (see an arrow AR2) to form a thin layer on the surface of development roller 43. Developer W is conveyed further upward with the rotation of development roller 43 (see an arrow AR3). Thereafter, developer W on development roller 43 develops the electrostatic latent image on the surface of image carrier 40 to form a toner image.

Part of developer W that does not pass through the nip section N passes through space S3 and upper end 30T in order (see an arrow AR4) and then returns into developer container 48 (see an arrow AR5).

Figure 4:
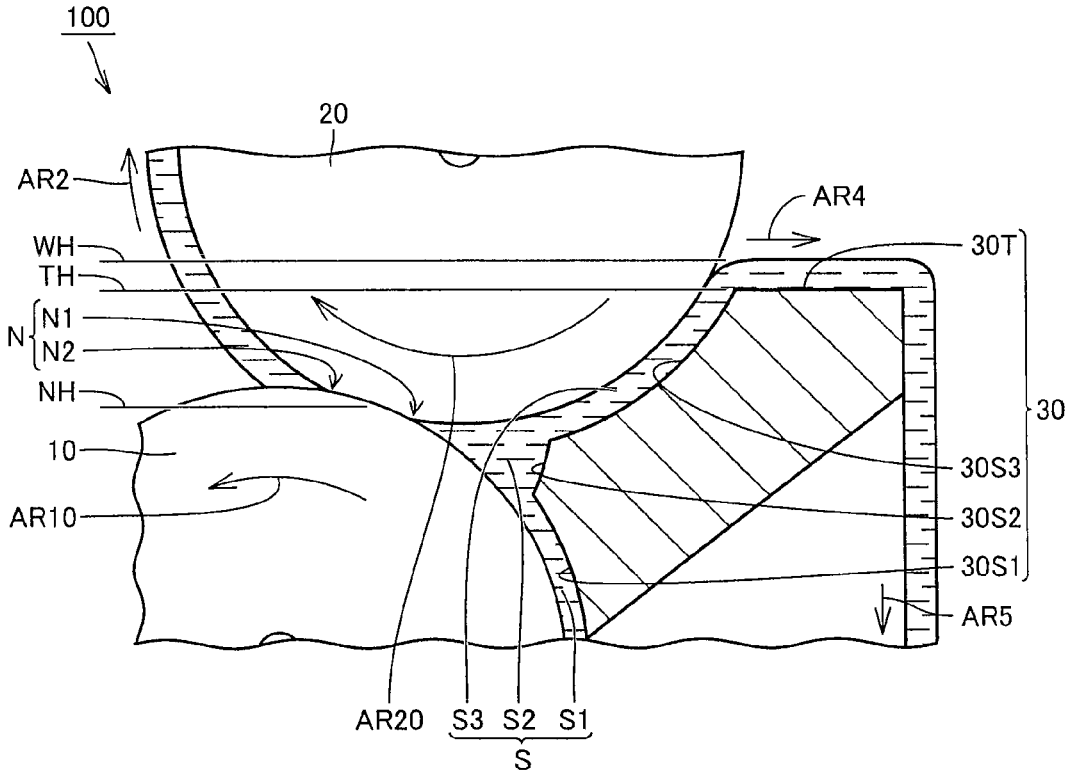
FIG. 4 is an enlarged cross-sectional view showing the vicinity of a nip section formed between the draw-up roller and the conveyance roller of the wet-type development device in the first embodiment.

FIG. 4 is an enlarged cross-sectional view showing the vicinity of the nip section N in wet-type development device 100. Referring to FIG. 4, a height TH in the vertical direction of upper end 30T of developer regulating member 30 in the present embodiment is configured such that a fluid level WH in the vertical direction in storage space S of developer W supplied to the nip section N is higher than a height NH in the vertical direction at the center of the nip section N when draw-up roller 10 and conveyance roller 20 are rotating to supply developer W to the nip section N. Here, the center of the nip section N is a part located exactly at the middle between an end N1 of the nip section N and an end N2 of the nip section N.

The nip section N is supplied with sufficient developer W since the fluid level WH in the vertical direction in storage space S of developer W supplied to the nip section N is higher than the height NH in the vertical direction at the center of the nip section N when developer W is being supplied to the nip section N. The similar effect can be brought about when at least the fluid level WH is higher than end N1 of the nip section N. However, preferably, the fluid level WH is higher than the height NH because developer W is supplied to the nip section more stably.

With the configuration above, developer W can accumulate generally uniformly with respect to the longitudinal direction of the nip section N (the axial direction of draw-up roller 10) in the vicinity of the nip section N on the upstream side of the nip section N. Accordingly, the pressure of developer W that enters the nip section N becomes constant, and the amount of developer W that passes through the nip section N also becomes constant.

In wet-type development device 100, the thin layer of developer W formed at the nip section N has a generally uniform thickness without thickness variations called streak noise. The toner image formed on image carrier 40 is also formed in a desired thickness. Therefore, wet-type image forming apparatus 200 including wet-type development device 100 can form a high-quality image on paper 50 (see FIG. 1).

In wet-type development device 100, part of developer W that does not pass through the nip section N passes through space S3 and upper end 30T in order (see arrow AR4) and then returns into developer container 48 (see arrow AR5). Pressure variations of developer W that enters the nip section are prevented in the vicinity of the nip section on the upstream side of the nip section N because excessive developer W is always spilled out from storage space S. Therefore, more uniform liquid accumulation is formed. The thickness of the thin layer formed by the nip section is thus more uniform.

The material of developer regulating member 30 and the shapes of inner peripheral surfaces 30S1, 30S2, and 30S3 of developer regulating member 30 are optimized in accordance with the kind of developer W, the material and shape of draw-up roller 10, and the material and shape of conveyance roller 20 such that more uniform liquid accumulation in a prescribed amount can be formed in the longitudinal direction of the nip section N.

Although wet-type development device 100 in the present embodiment has draw-up roller 10, conveyance roller 20, and development roller 43, conveyance roller 20 may perform the function of development roller 43, and the wet-type development device may be constituted with two rollers.

Figure 5:
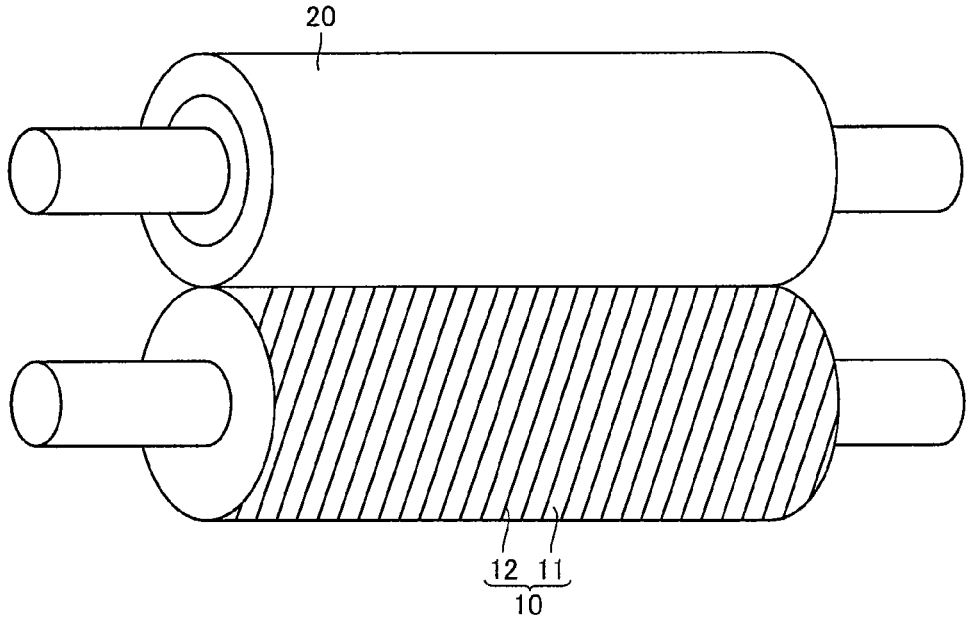
FIG. 5 is a perspective view showing a configuration of the draw-up roller and the conveyance roller that may be used in the wet-type development device in the first embodiment.
Figure 6:
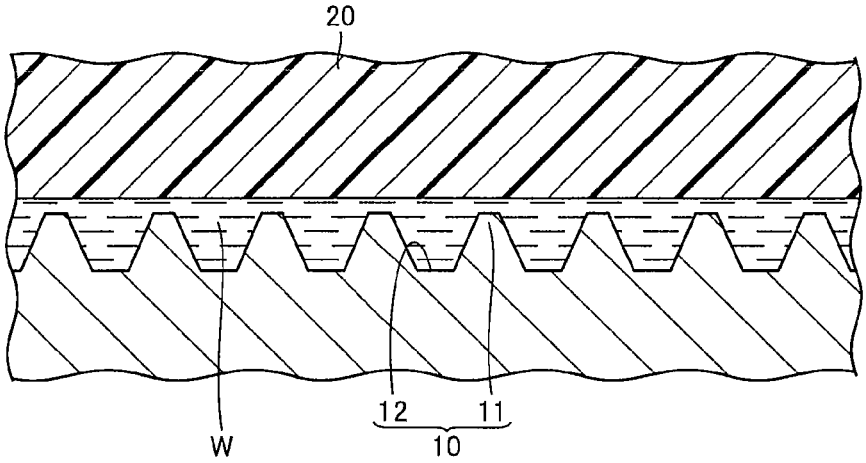
FIG. 6 is a cross-sectional view showing a configuration of the draw-up roller and the conveyance roller that may be used in the wet-type development device in the first embodiment.

FIG. 5 is a perspective view showing a configuration of draw-up roller 10 and conveyance roller 20 that may be used in wet-type development device 100. FIG. 6 is a cross-sectional view showing a configuration of draw-up roller 10 and conveyance roller 20 that may be used in wet-type development device 100.

Referring to FIG. 5 and FIG. 6, in wet-type development device 100 above in the present embodiment, an anilox roller having a plurality of grooves 12 on a surface 11 of a metal cylindrical or columnar member may be used as draw-up roller 10. With this configuration, an appropriate amount of developer W can be supplied to the surface of draw-up roller 10. A member having an elastic surface layer may be used as conveyance roller 20.

[Second Embodiment]

Figure 7:
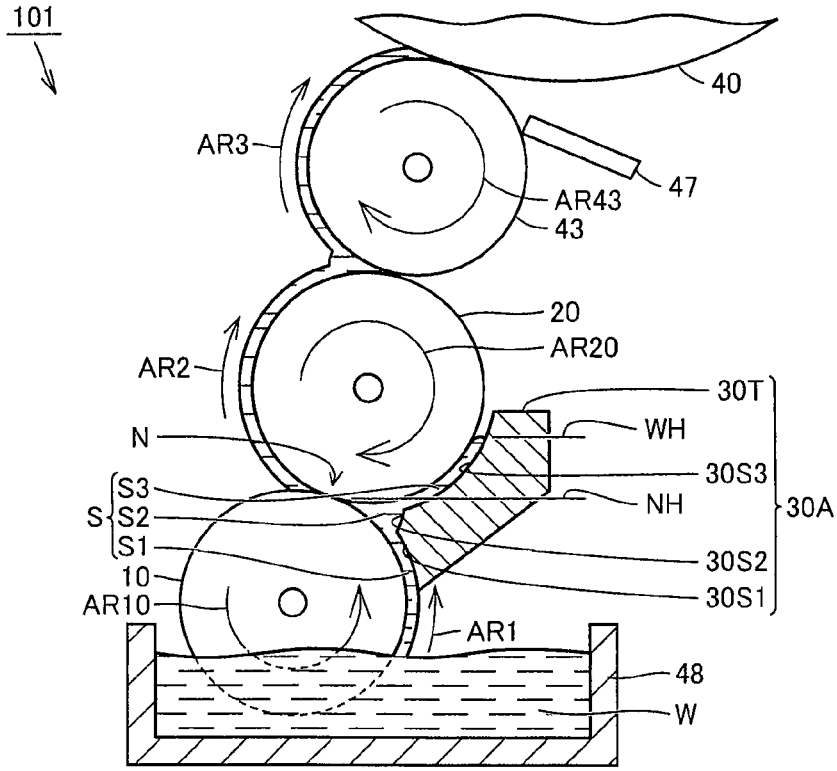
FIG. 7 is a cross-sectional view showing the vicinity of the draw-up roller, the conveyance roller, and a developer regulating member that may be included in a wet-type development device in a second embodiment.

FIG. 7 is a cross-sectional view showing the vicinity of draw-up roller 10, conveyance roller 20, and a developer regulating member 30A included in a wet-type development device 101 in the present embodiment. In FIG. 7, wet-type development device 101 is in operation.

In developer regulating member 30A in wet-type development device 101, upper end 30T of developer regulating member 30A is provided higher than that of developer regulating member 30 (see FIG. 4) in the foregoing first embodiment. In this configuration, developer regulating member 30A is also configured such that the fluid level WH in the vertical direction in storage space S of developer W supplied to the nip section N is higher than the height NH in the vertical direction at the center of the nip section N.

In wet-type development device 101, part of developer W that does not pass through the nip section N passes through space S3 and then flows out from the opposite ends in the longitudinal direction of the nip section N (the vertical direction on the drawing sheet of FIG. 7) to return into developer container 48. In wet-type development device 101, developer W can also accumulate generally uniformly with respect to the longitudinal direction of the nip section N (the axial direction of draw-up roller 10) in the vicinity of the nip section N on the upstream side of the nip section N. The pressure of developer W that enters the nip section N becomes constant because a prescribed amount of uniform liquid accumulation is formed in the longitudinal direction of the nip section N. Thus, the amount of developer W that passes through the nip section N also becomes constant.

In wet-type development device 101, the thin layer of developer W formed at the nip section N has a generally uniform thickness without thickness variations called streak noise. The toner image formed on image carrier 40 is also formed in a desired thickness. Therefore, the wet-type image forming apparatus including wet-type development device 101 can form a high-quality image on paper 50 (see FIG. 1).

[Third Embodiment]

Figure 8:
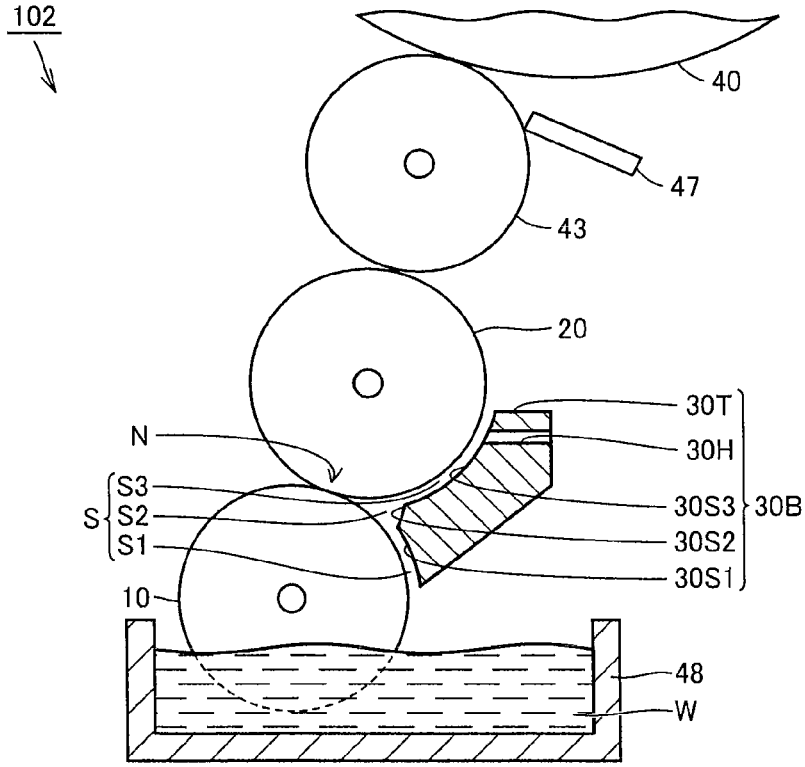
FIG. 8 is a cross-sectional view showing the vicinity of the draw-up roller, the conveyance roller, and a developer regulating member included in a wet-type development device in a third embodiment (the wet-type development device is at rest).
Figure 9:
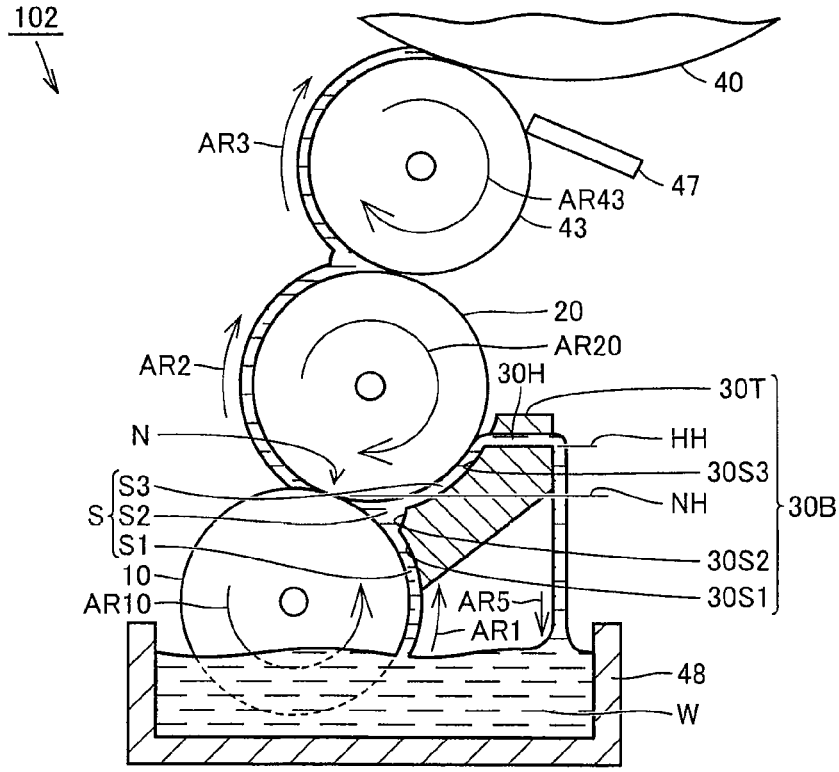
FIG. 9 is a cross-sectional view showing the vicinity of the draw-up roller, the conveyance roller, and the developer regulating member included in the wet-type development device in the third embodiment (the wet-type development device is in operation).

Referring to FIG. 8 and FIG. 9, a wet-type development device 102 in the present embodiment will be described. FIG. 8 is a cross-sectional view showing the vicinity of draw-up roller 10, conveyance roller 20, and a developer regulating member 30B included in wet-type development device 102. In FIG. 8, wet-type development device 102 is at rest. FIG. 9 is a cross-sectional view showing the vicinity of draw-up roller 10, conveyance roller 20, and developer regulating member 30B included in wet-type development device 102. In FIG. 9, wet-type development device 102 is in operation.

As shown in FIG. 8, in wet-type development device 102, developer regulating member 30B has an opening 30H (drainage pathway). Opening 30H is provided on inner peripheral surface 30S3 of developer regulating member 30B. Opening 30H connects space S3 to a space on the back side of developer regulating member 30B.

As shown in FIG. 9, opening 30H of developer regulating member 30B is configured such that a height HH in the vertical direction of opening 30H (at the bottom surface thereof) is higher than the height NH in the vertical direction at the center of the nip section N.

With this configuration, part of developer W that does not pass through the nip section N passes through the inside of space S3 and opening 30H in order and then returns into developer container 48 (see arrow AR5). In wet-type development device 102, developer W can also accumulate generally uniformly with respect to the longitudinal direction of the nip section N (the axial direction of draw-up roller 10) in the vicinity of the nip section N on the upstream side of the nip section N. The pressure of developer W that enters the nip section N becomes constant because a prescribed amount of uniform liquid accumulation is formed in the longitudinal direction of the nip section N. Thus, the amount of developer W that passes through the nip section N also becomes constant.

In wet-type development device 102, the thin layer of developer W formed at the nip section N has a generally uniform thickness without thickness variations called streak noise. The toner image formed on image carrier 40 is also formed in a desired thickness. Therefore, the wet-type image forming apparatus including wet-type development device 102 can form a high-quality image on paper 50 (see FIG. 1).

[Fourth Embodiment]

Figure 10:
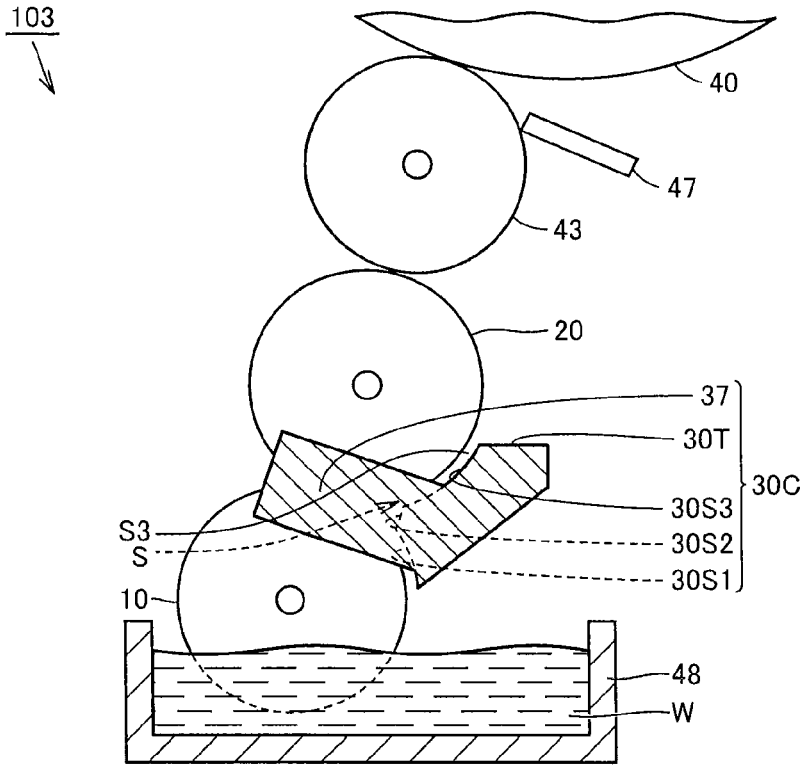
FIG. 10 is a cross-sectional view showing the vicinity of the draw-up roller, the conveyance roller, and a developer regulating member included in a wet-type development device in a fourth embodiment (the wet-type development device is at rest).
Figure 11:
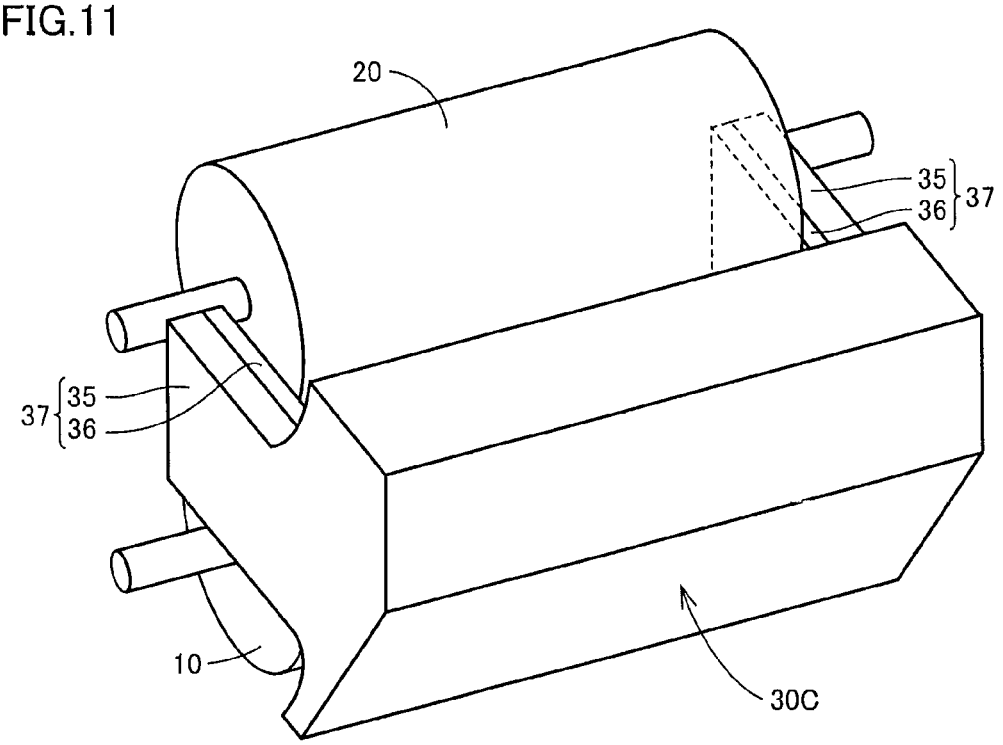
FIG. 11 is a perspective view of the draw-up roller, the conveyance roller, and the developer regulating member included in the wet-type development device in the fourth embodiment.

Referring to FIG. 10 and FIG. 11, a wet-type development device 103 in the present embodiment will be described. FIG. 10 is a cross-sectional view showing the vicinity of draw-up roller 10, conveyance roller 20, and a developer regulating member 30C included in wet-type development device 103. In FIG. 10, wet-type development device 103 is at rest. FIG. 11 is a perspective view showing draw-up roller 10, conveyance roller 20, and developer regulating member 30C included in wet-type development device 103.

As shown in FIG. 10, in wet-type development device 103, developer regulating member 30C has side walls 37. Side walls 37 are provided to cover the opposite ends in the longitudinal direction (the vertical direction on the drawing sheet of FIG. 10) of the nip section N (see FIG. 2, etc.).

Referring to FIG. 11, side wall 37 includes an outer wall portion 35 and an inner wall portion 36. Outer wall portion 35 may be formed integrally with the member that forms developer regulating member 30C. Inner wall portion 36 is formed of a seal member such as urethane foam.

This configuration prevents developer W from flowing out from the opposite ends of the nip section N. Developer W can accumulate more uniformly with respect to the longitudinal direction of the nip section N (the axial direction of draw-up roller 10) in the vicinity of the nip section N on the upstream side of the nip section N. In wet-type development device 103, part of developer W that does not pass through the nip section N passes through space S3, flows out from upper end 30T, and then returns into developer container 48. The pressure of developer W that enters the nip section N becomes constant because excessive developer W is always spilled out from storage space S thereby forming a prescribed amount of uniform liquid accumulation in the longitudinal direction of the nip section N. Thus, the amount of developer W that passes through the nip section N also becomes constant.

In wet-type development device 103, the thin layer of developer W formed at the nip section N has a generally uniform thickness without thickness variations called streak noise. The toner image formed on image carrier 40 is also formed in a desired thickness. Therefore, the wet-type image forming apparatus including wet-type development device 103 can form a high-quality image on paper 50 (see FIG. 1).

[Fifth Embodiment]

Figure 12:
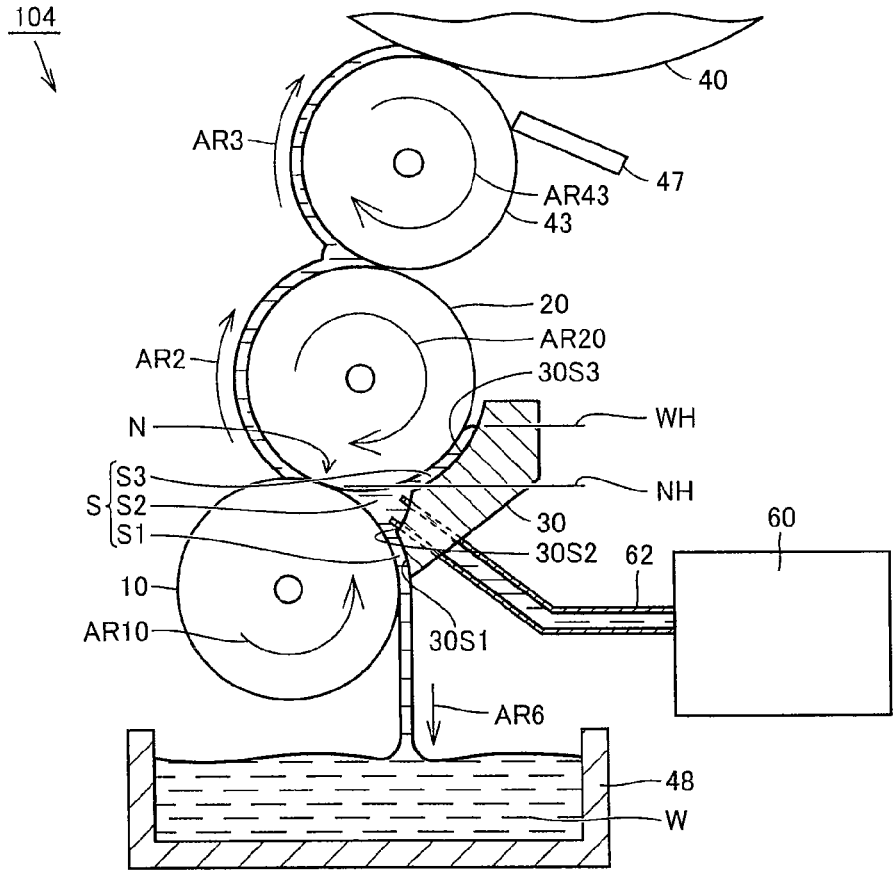
FIG. 12 is a cross-sectional view showing the vicinity of the draw-up roller, the conveyance roller, the developer regulating member, and a developer supply pump included in a wet-type development device in a fifth embodiment.
Figure 13:
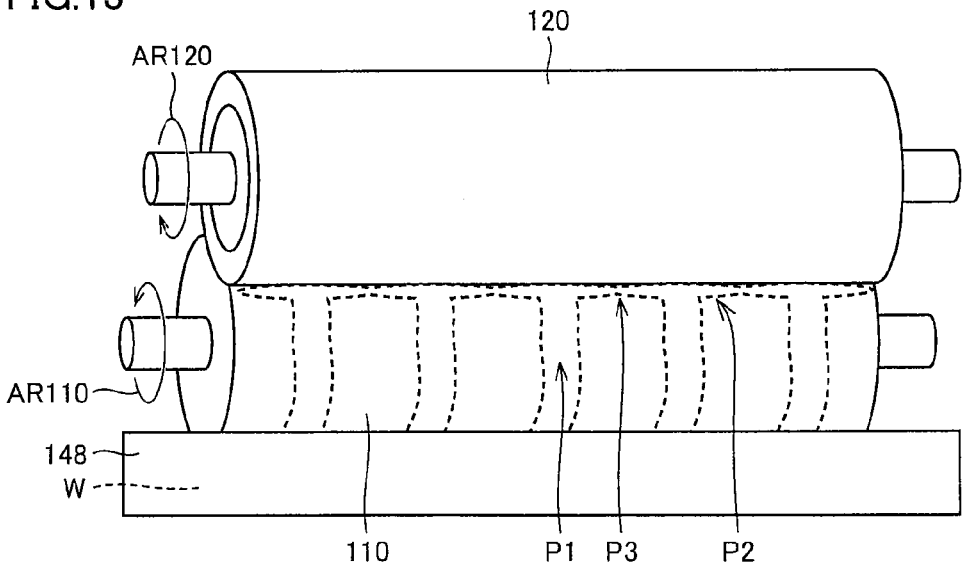
FIG. 13 is a perspective view showing a draw-up roller and a conveyance roller included in a general wet-type development device.

Referring to FIG. 12, a wet-type development device 104 in the present embodiment will be described. FIG. 12 is a cross-sectional view showing the vicinity of draw-up roller 10, conveyance roller 20, developer regulating member 30, and a developer supply pump 60 included in wet-type development device 104.

In wet-type development device 104, developer supply pump 60 is used for supplying developer W toward the nip section N. Draw-up roller 10 does not have to be soaked in developer W stored in developer container 48. A pipe 62 of developer supply pump 60 for supplying developer W from developer supply pump 60 toward the nip section N, that is, to storage space S, connects to storage space S (space S2) through the inside of developer regulating member 30. In wet-type development device 104, part of developer W that does not pass through the nip section N is spilled out through space S1 (see an arrow AR6).

In wet-type development device 104, developer W can also accumulate generally uniformly with respect to the longitudinal direction of the nip section N (the axial direction of draw-up roller 10) in the vicinity of the nip section N on the upstream side of the nip section N. The pressure of developer W that enters the nip section N becomes constant because a prescribed amount of uniform liquid accumulation is formed in the longitudinal direction of the nip section N. Thus, the amount of developer W that passes through the nip section N also becomes constant.

In wet-type development device 104, the thin layer of developer W formed at the nip section N has a generally uniform thickness without thickness variations called streak noise. The toner image formed on image carrier 40 is also formed in a desired thickness. Therefore, the wet-type image forming apparatus including wet-type development device 104 can form a high-quality image on paper 50 (see FIG. 1).

Pipe 62 may be used to supply developer W onto the surface of draw-up roller 10 so that developer W is supplied toward the nip section N with the rotation of draw-up roller 10.

Pipe 62 may also be used to supply developer W such that developer W is poured to storage space S from above developer regulating member 30.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A wet-type development device using liquid developer comprising:

a first rotatable member and a second rotatable member configured to rotate being in contact with each other's surfaces; and a developer regulating member arranged facing to and keeping a distance from a nip section between the first and second rotatable members, wherein the developer regulating member forms a storage space for storing developer to be supplied toward the nip section on an upstream side of the nip section with respect to a direction in which the first and second rotatable members are rotating, and wherein a fluid level in the vertical direction of the developer in the storage space is higher than the nip section when the developer is being supplied to the nip section.

2. The wet-type development device of claim 1, wherein the fluid level in the vertical direction of the developer in the storage space is higher than the center of the nip section when the developer is being supplied to the nip section.

3. The wet-type development device of claim 1, wherein the developer regulating member has a drainage pathway located higher than the nip section, and a part of the developer stored in the storage space is spilled out through the drainage pathway when the developer is being supplied to the nip section.

4. The wet-type development device of claim 1, wherein the developer regulating member has side walls to cover both ends in a longitudinal direction of the nip section.

5. The wet-type development device of claim 1, wherein the developer is supplied to the first rotatable member and then the first rotatable member carries the developer to the storage space.

6. The wet-type development device of claim 5, wherein the first rotatable member is soaked in the developer stored in a container and is configured to dip out and carry the developer to the storage space while rotating.

7. The wet-type development device of claim 1, further comprising a pump for supplying the developer to the storage space, wherein a pipe of the pump, in which the developer is conveyed from the pump, connects to the storage space penetrating through the developer regulating member.

8. The wet-type development device of claim 1, wherein the first rotatable member is an anilox roller.

9. A wet-type image forming apparatus using liquid developer comprising:

(A) a wet-type development device including a first rotatable member and a second rotatable member configured to rotate being in contact with each other's surfaces, and a developer regulating member arranged facing to and keeping a distance from a nip section between the first and second rotatable members; and (B) an image carrier on which surface a latent image is formed, and wherein the latent image is developed with the developer carried through the nip section, wherein the developer regulating member forms a storage space for storing developer to be supplied toward the nip section, on an upstream side of the nip section with respect to a direction in which the first and second rotatable members are rotating, and wherein a fluid level in the vertical direction of the developer in the storage space is higher than the nip section when the developer is being supplied to the nip section.

10. The wet-type image forming apparatus of claim 9, wherein the fluid level in the vertical direction of the developer in the storage space is higher than the center of the nip section when the developer is being supplied to the nip section.

11. The wet-type image forming apparatus of claim 9, wherein the developer regulating member has a drainage pathway located higher than the nip section, and a part of the developer stored in the storage space is spilled out through the drainage pathway when the developer is being supplied to the nip section.

12. The wet-type image forming apparatus of claim 9, wherein the developer regulating member has side walls to cover both ends in a longitudinal direction of the nip section.

13. The wet-type image forming apparatus of claim 9, wherein the developer is supplied to the first rotatable member and then the first rotatable member carries the developer to the storage space.

14. The wet-type image forming apparatus of claim 13, wherein the first rotatable member is soaked in the developer stored in a container and is configured to dip out and carry the developer to the storage space while rotating.

15. The wet-type image forming apparatus of claim 9, further comprising a pump for supplying the developer to the storage space, wherein a pipe of the pump, in which the developer is conveyed from the pump, connects to the storage space penetrating through the developer regulating member.

16. The wet-type image forming apparatus of claim 9, wherein the first rotatable member is an anilox roller.

* * * * *